US005144599A

United States Patent [19]

Blaich et al.

[11] Patent Number: 5,144,599

[45] Date of Patent: Sep. 1, 1992

[54] AUTONOMOUS RADIO-CONTROLLED TIMEPIECE

[75] Inventors: Wilfried Blaich, Schramberg; Oskar Flaig, Eschbronn/Locherhof; Wolfgang Ganter; Hans Kaiser, both of Schramberg; Ewald Kussmaul, Freudenstadt; Roland Maurer, Lauterbach; Peter Riis, Deisslingen, all of Fed. Rep. of Germany

[73] Assignee: Junghans Uhren GmbH, Schramberg, Fed. Rep. of Germany

[21] Appl. No.: 635,692

[22] Filed: Dec. 28, 1990

[30] Foreign Application Priority Data

Jan. 27, 1990 [DE] Fed. Rep. of Germany ..... 9000899

[51] Int. Cl.[5] ..... G04B 47/00; G04B 37/00

[52] U.S. Cl. ..... 368/10; 368/282

[58] Field of Search ..... 368/88, 10, 47, 281–282

[56] References Cited

U.S. PATENT DOCUMENTS

| | | | |
|---|---|---|---|
| 3,971,207 | 7/1976 | Murakami et al. | 368/282 |
| 4,194,355 | 3/1980 | Nishida | 368/282 |
| 4,427,303 | 1/1984 | Matthias | 368/282 |
| 4,586,827 | 5/1986 | Hirsch et al. | 368/282 |
| 4,690,567 | 9/1987 | Rebeaud | 368/283 |
| 4,847,818 | 7/1989 | Olsen | 368/10 |
| 4,884,252 | 11/1989 | Teodobiois et al. | 368/10 |
| 4,947,179 | 8/1990 | Ganter et al. | 455/351 |
| 4,977,614 | 12/1990 | Kurcbart | 368/10 |
| 5,020,039 | 5/1991 | Yoketz | 368/282 |

FOREIGN PATENT DOCUMENTS

| | | |
|---|---|---|
| 0242717 | 10/1987 | European Pat. Off. . |
| 8815378 | 3/1989 | Fed. Rep. of Germany . |
| 61-181203 | 1/1987 | Japan . |
| 2201266 | 8/1988 | United Kingdom . |

*Primary Examiner*—Vit W. Miska

*Attorney, Agent, or Firm*—Burns, Doane, Swecker & Mathis

[57] ABSTRACT

An autonomous radio timepiece comprises a casing and a bracelet attached thereto. The casing includes an operating circuit, while the bracelet carries a flexible antenna. The antenna can be removed from the bracelet in the event that the bracelet is worn and must be discarded. The antenna carries a plug-in type connector at one end which is adapted to make a tight sealing connection with the casing, and is also adapted to electrically connect the antenna with the circuit of the casing. The circuit within the casing includes a receiver which is fixedly tuned as a function of the antenna inductivity of a foil core to the time message transmitter. Also provided is a variable automatic supplemental tuner to compensate for bending of the bracelet while the receiver is actuated. The antenna comprises a foil of an insulting material on which an antenna conductor is printed, along with two shielding conductors extending parallel to the antenna conductor.

14 Claims, 4 Drawing Sheets

48
48
47'
57
60
26'
58
69
59
54
49
48
48
61
64
62
62
63
54
64
58
62
62
52
69
63
54

AUTONOMOUS RADIO-CONTROLLED TIMEPIECE

BACKGROUND OF THE INVENTION

The invention concerns an autonomous radio timepiece having a flexible magnetic antenna.

The expression "radio timepiece" used herein is intended to signify a receiver for coded, absolute time information periodically transmitted by radio, when then decodes and displays the information received; it is not intended to signify a radio or television receiving device (carried for example on the arm) or a personal paging device that may be equipped additionally with a timepiece.

In the case of an autonomous radio timepiece, the receiver is equipped with a timekeeping circuit in order to advance the time display during intervals in which no valid time information is being received (e.g., during intervals of transmission interruptions or international deactivations for conserving energy). A valid time information is one that satisfies certain plausibility conditions, which for example are present if two time informations received in succession exhibit exactly the time difference known and given by the transmitter. If the instantaneous time display does not coincide with the instantaneously determined valid time information (due for example to display errors or a daylight saving change in time), the display is corrected by means of the instantaneously received valid time information, and the advance is resumed from this corrected position by means of the timing pulse generator of the internal timekeeping circuit. For details, reference is made to German Document GM 88 15 378 and U.S. Pat. No. 4,947,179 concerning a radio timepiece of this generic type, the disclosures of which are incorporated by reference herein.

It is an object of the invention to provide an efficient and readily manufactured autonomous radio timepiece of this generic type in the form of a wristwatch.

SUMMARY OF THE INVENTION

This object is attained according to the invention which involves an autonomous radio timepiece comprising a wristwatch casing, and an operating circuit and receiver disposed in the casing. A wrist bracelet is provided which has an internal channel, and an antenna removably disposed in the channel The antenna includes a flexible support. The bracelet includes a plug connector which is attachable to the casing and includes means connecting the antenna with the circuit.

Preferably, the casing forms a recess for receiving the plug connector. The recess opens toward an underside of the casing This solution creates a functionally optimized casing-wristwatch combination, since in the case of a worn-out bracelet, only the outside or sheathing of the bracelet must be replaced, while the electrically operated antenna, which is tuned to the inlet circuit of the receiver, can be inserted into a new bracelet For this reason, the sleeve of the bracelet is not fastened directly to the wristwatch casing (in contrast to the conventional link articulation), but rather is fastened to a plug connector located at an end of the bracelet. The plug connector makes a stress-relieved and water-tight mechanical and electrical connection to the casing and to a connecting pin thereof which connects to the receiver of the clock circuit. The sheathing-like portion of the bracelet holding the flexible magnetic antenna (which comprises a flexible stack core wound by the antenna coil) terminates at its connection with the plug in two tongues of different lengths, the shorter tongue is located on the outside of the curve of the bracelet and is connected directly with a holding plate (which also carries an electrical bush of the plug connector), while the longer, inner tongue may end at a holding strip positively connected with the underside side of the plug connector, if the plug connector is secured by fasteners to the watch casing.

The flexible antenna support is provided with a lug, so that the antenna may be drawn into the bracelet channel by means of a thin pool passing through a narrow opening on the inside curve of the bracelet. The flexible support may comprise a flexible support for the insulation of a laminated antenna circuit. A flat oscillating circuit tuning capacitor is mounted on that flexible support, along with antenna cable shielding by means of printed parallel grounding conductors. The antenna core and antenna coil on the one hand, and the antenna support on the other hand, are centered conveniently in the longitudinal direction of the support by necking down the support and the core stack and mounting the coil in the neck area around a coil support formed by lateral straps clapped around the tapered area on the antenna support. If the laminated flex support is located on the inside of the curve of the antenna core stack and the plug connector holding means, there are no sharp edges or folds, so that with few structural parts and connectors, i.e., in a few working steps, a reliable electrical and mechanical connection is obtained between the bracelet and the casing of the radio watch, the connection being handled and serviced in a simple manner.

BRIEF DESCRIPTION OF THE DRAWINGS

The objects and advantages of the invention will become apparent from the following detailed description of preferred embodiments thereof n connection with the accompanying drawings, in which like numerals designate like elements, and in which.

DETAILED DESCRIPTION OF PREFERRED EMBODIMENTS OF THE INVENTION

Figure 4:
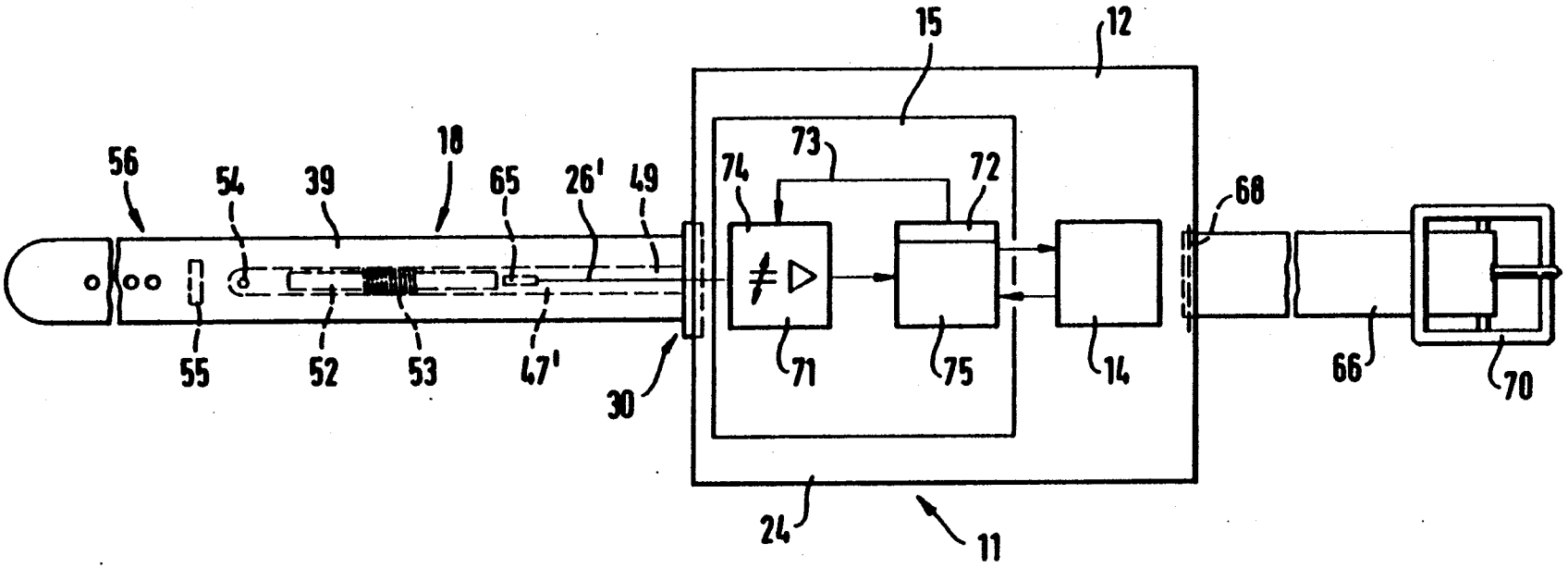
FIG. 4 depicts schematically a radio wristwatch according to FIG. 1 including a simplified block circuit diagram therefor.

A preferred autonomous radio watch 11 according to the invention comprises a watch casing 12, on which the time display (digital or analog and as an electromechanical display system or an electro-optical display) is visible through a crystal 13. Located beneath or adjacent to the display is a clock circuit 15 which, in the case of the radio 11, essentially comprises a tuned time message receiver 71 with a demodulator and memory comparison circuits of a display control circuit 75 (FIG. 4). The circuit is powered by at least one button cell battery 16, which is held and contacted by means of a removable casing bottom 17 under the watch circuit 15.

Figure 2:
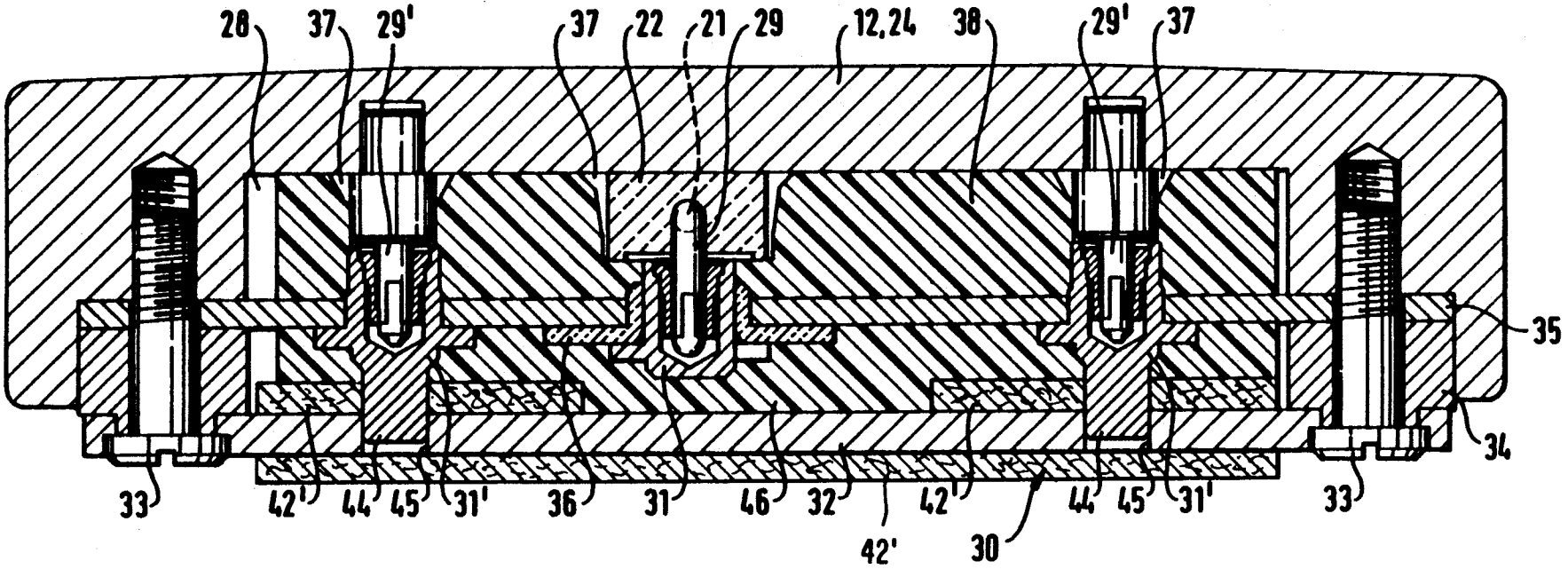
FIG. 2 is a cross-section taken along line II—II in FIG. 1.

The connection of a flexible magnetic antenna 18 with a receiver side of the watch circuit 15 is established by a contact spring 20 fastened to a circuit support 19 and abutting against a contact pin 21. The pin 21 is held in an insulation passage 22 and extends approximately from the inside 23 of the casing through the casing wall 24. The contact pin 21 is in the form of an angled hook, the longer leg of which extends approximately parallel to the display side surface 27 of the casing and abuts against the contact spring 20. The shorter leg is projecting parallel to the height of the casing 12 from a recess 28 on the bottom side of the casing wall 24 to define a freely accessible plug pin 29 (FIG. 2). Grounding plug pins 29' located adjacent both sides of the plug pin 29 are anchored directly on the casing wall 24.

A plug connector 30 engages in the casing recess 28, which recess is accessible from below. The plug connector includes coupling bushes 31, 31' which are shaped and located suitably for receiving the plug pins 29, 29'. The bushes are anchored in a metal holding plate 35. The latter extends laterally over the width of the connector recess 28, so that with the pin-bush a pair 29–31/29'–31' inserted into each other, the plate 35 may be secured within the recess 28 by means of screws 33 which attach to the watch casing 12. The coupling bush 31 is fitted within an insulating bush 36.

The holding plate 35 is equipped in the rear with at least one spacing element 34, followed by a watch connecting strip 32. The strip 32 extends across the transverse extent of the plug connector recess 28, so that the screws fasten the multi-layer structure, comprised of the connecting strip 32, the spacing elements 34 and the holding plate 35, to the casing wall 24. A molded bar 38, equipped on its frontal side with funnel-shaped recesses 37 for sealingly engaging the pins 29, 29', extends on either side along the holding plate 35 and provides a positive humidity tight seal of the plug connection.

The bushes 31, 31' and the holding plate 35 are integrally molded within the plastic sealing bar 38.

The sleeve-like antenna bracelet 39 terminates on the casing side in two strap lips or tongues 42, 42' located above and below each other. The outer strap tongue 42 is wound around a shaft 43 mounted in lugs 41 formed on the holding plate 35. The strap tongue 42' located on the bottom side, i.e., on the inside of the bracelet curve, is wound around the connecting strip 32, which is geometrically fitted to the sealing bar 38. The strip 32 is positively connected with the holding plate 35 in the assembled state by means of downwardly projecting pegs 44 of the bushes 31'. Those pegs 44 project into receiving holes 45 of the strip 32, as seen in FIG. 2, and also project through the lower strap tongue 42'. A center area 46 (FIG. 2) of the strap tongue 42' wound around the connecting strip 32 is conveniently recessed, whereby the molding material forming the sealing bar 38 can enter that recess in order to form a greater thickness of the bar 38 below the plug pin 29 for facilitating the embedding of the coupling antenna bush 31.

Figure 1:
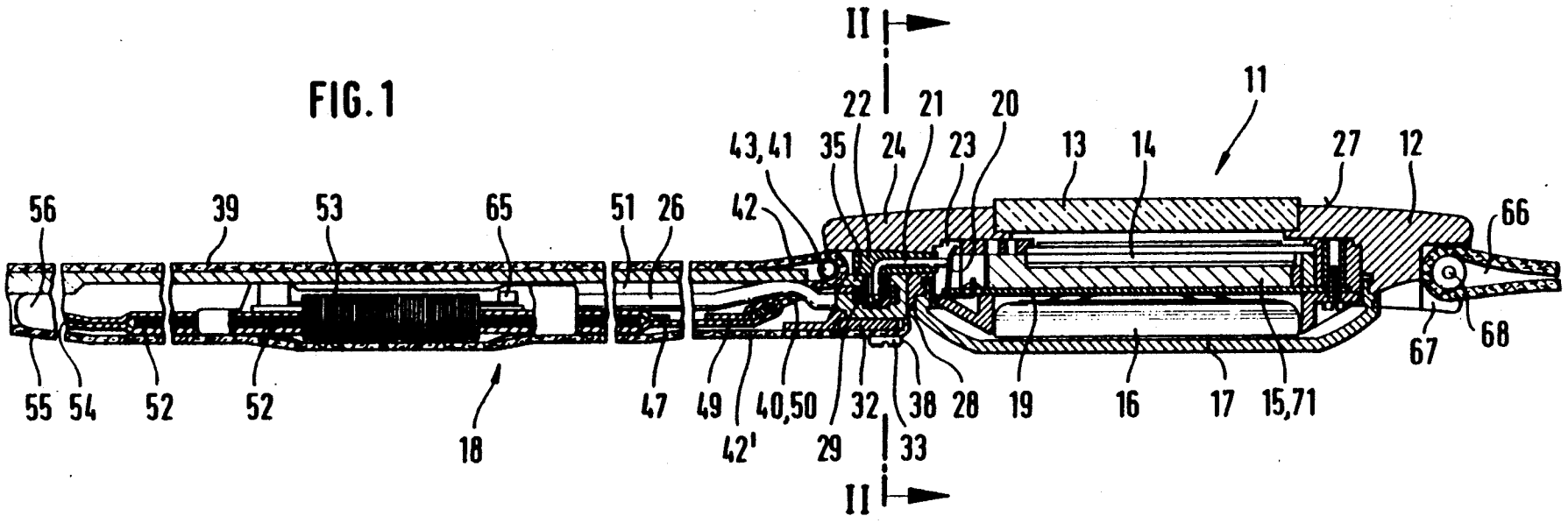
FIG. 1 shows an autonomous radio wristwatch in longitudinal section, including a flexible magnetic antenna and a bracelet articulated onto a watch casing.
Figures 3, 3A, 3B, 3C:
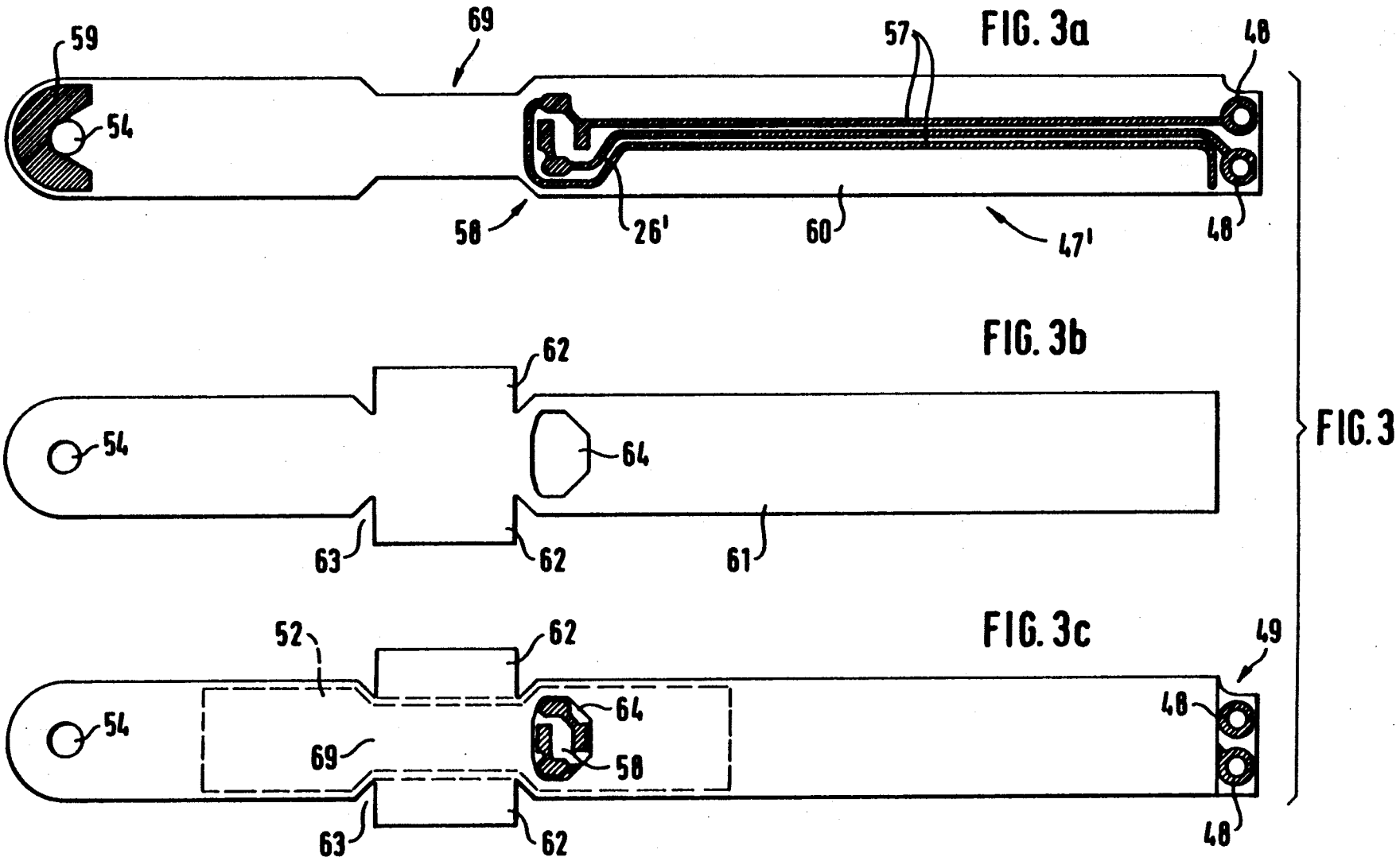
FIG. 3 (consisting of FIGS. 3*a*, 3*b*, 3*c*) depicts a sandwich or lamination structure of an antenna support modified relative to that of FIG. 1 and extending through one of the bracelets.

A flexible antenna support 47 is fastened directly to the holding plate 35 or to an optionally available projection 40 of the plate 35. If the antenna support extends directly to the holding shoulder 35, the antenna support may be fastened mechanically in tension by passing the plug bushes 31, 31' through the holes 48 in the antenna support 47 (FIG. 3), thereby attaching the fastening end of the antenna support 47 within the plastic bar 38. If, on the other hand, the antenna support 47 according to FIG. 1 is for example a strip of fabric, the latter is conveniently fastened to the holding plate 35 by passing the antenna support 47 through an opening 50 in the projection 40 and sewing the antenna support 47 or adhesively bonding it to the projection 40. The projection 40 is inclined downwardly into the end of the bracelet 39.

In any case, the antenna support 47 extends from the plug holding plate 35 between the bracelet strap tongues 42, 42' into a blind hole like or sleeve-shaped flat channel 51 and past a flexible core 52 of the antenna coil 53.

The bracelet has an opening 55 in the inner strap tongue 42'. The antenna support 47 has a lug 54 opposite the holding shoulder 35 for the engagement of a tool (not shown), for example a wire with a hook at its end. The hook end of the tool can be inserted into the channel 51 through the opening 55. Then, the hook can be connected to the lug 54 and pulled back through the opening 55 in order to draw the antenna support 47 into the channel 51 (i.e., from right-to-left in FIG. 1). Thus, if a worn antenna bracelet 39 is to be replaced, the antenna 18 itself is not lost. Rather, it is merely necessary to remove the antenna and its plug connector from the sheathing 42, 42' of the bracelet, and pull the antenna into a new sheathing via the tool described above. Beyond the end of the blind hole 56 (i.e., to the left in FIG. 1) the bracelet 39 has the form of a conventional, multilayer, perforated flat strap for connection by a wristwatch band closure 70 (FIG. 4).

The electrical connection of the antenna 18 to the inlet of the receiver 71 of the electronic clock circuit 15 may, according to FIG. 1, be effected by a discrete coaxial antenna conduit 26, which extends loosely along the antenna support 47 and is thereby relieved of tensile stress. Alternatively, however, the antenna conduit (FIG. 3) may be integrated into an antenna support 47', for example in the manner of a conductor 26' laminated onto a strip of an insulating material. It is sufficient for shielding purposes to laminate additional conductors 57 parallel to the antenna conducted 26' onto the material of the support 47', preferably on both sides tightly parallel to the antenna conductor 26' and surrounding it in a U-shaped manner in the area of the connection. The conductor 26', together with the unilateral ground connection of the two shielding conductors 57 connected in series, are then connected to the plug bushes 31, 31' in the vicinity of the fastening holes 48. Thus, by way of the plug pins 29, 29' the conductor 26' and shielding connectors 57 are connected to the electronic clock circuit 15 (FIG. 1). The opposite end of such an insulating support 47' (laminated with the conductors 26', 57) is appropriately also laminated in the vicinity of the lug 54 with a metal layer 59 serving as a reinforcement, in order to obtain better protection against tearing during the drawing-in of the bracelet sleeve into the channel 51.

Preferably, a foil 60 printed with the conductors (FIG. 3*a*) on a Kapton base is covered over its laminated surface by a flexible, thin sheet of insulating material 61 (FIG. 3*b*), which is configured in conformance with the strip shaped geometry of the antenna support 47' and which extends to a point short of the holding and connecting holes 48. The sheet 61 includes two flap like tabs 62, projecting laterally from a reduced width or restriction area 63. Those tabs are to be looped around a geometrically corresponding reduced width area 69 of the strip shaped sheet metal stack antenna core 52, located opposite the laminated surface of the foil. Those tabs, together with the lateral edges of the supporting foil 60, their cover 61 and the core 52, define a coil support around which the antenna coil 53 is to be wound. By means of a recess 64 formed in the cover foil 61, the conductor connecting area 58 is accessible, in order to mechanically and electrically connect in this location the coil wires and optionally also an oscillating circuit tuning capacitor 65 (FIG. 1), for example by soldering. The recess 64 may be situated between the coil and the fastening end (FIG. 3c), or even better, between the core and the fastening end 47.

Appropriately, protective hoods are pushed over the frontal ends of the lamellar core 52, in order to prevent them from lifting off the bent support 47', and to prevent the wearing through of the bracelet sleeve drawing over them (not shown)

While one end of the flat sleeve of the antenna bracelet 39 is connected with the watch casing 12 by means of the plug 30, the opposite end includes a conventional but shorter half-band 66 which is articulated in the usual manner onto the casing 12, for example by looping it around a hinge axle 68 (FIG. 1) held between the projections 67.

When the watch 11 is being worn, the antenna bracelet 39 has a curved configuration in the longitudinal direction in keeping with the bending direction determined by manufacturing of the core lamella, which are oriented with the inside of their curvature toward the wrist of the wearer 47. Because of the limited resetting or restoring force of the layered core 52, that curvature is not automatically straightened completely merely by opening the closure of the bracelet 70. For this reason, the demodulator-receiver 71 of the lock circuit 15 is conveniently tuned on the inlet side to resonance conditions corresponding to the antenna inductivity at a mean bending radius of the core 52, so that an optimum receiving sensitivity is given, assuming that the receiver 71 is periodically actuated by the autonomous timekeeping circuit 72 by means of a control line 73 for the surveillance and possible correction of the time display 14.

However, if this actuation takes place when the watch 11 is laid down with an intentionally straightened bracelet 39, this results in a false tuning of the inlet circuit of the receiver with a correspondingly reduced receiving sensitivity. It is, therefore, advisable to provide in the receiver an electrically resettable or retainable inlet resonance circuit 74, as indicated in FIG. 4. In this manner, the receiving sensitivity is always optimized at the time of reception relative to the instantaneous antenna inductivity as a function of curvature.

Concerning the operation of the display control circuit 75, which is set by the absolute time information received by radio and operated to the next reception by the autonomous timekeeping circuit 72, attention is directed in particular to European Application No. 0 242 717-A2.

Although the present invention has been described in connection with preferred embodiments thereof, it will be appreciated by those skilled in the art that additions, modifications, substitutions, and deletions not specifically described may be made without departing from the spirit and scope of the invention as defined in the appended claims

What is claimed is:

1. An autonomous radio timepiece comprising a wristwatch casing; a clock timekeeping circuit and a receiver disposed in said casing; a wrist bracelet connected to said casing and having an internal channel; an antenna removably disposed in said channel for receiving radio signals; said antenna including a flexible support carrying a core; a coil wound around said core, and an oscillating circuit capacitor, whereby said flexible support, core, coil, and oscillating circuit capacitor are removable as a unit from said channel; said bracelet including a plug connector removably attachable to said casing, said plug connector including means electrically connecting said antenna with said clock timekeeping circuit, whereby said clock timekeeping circuit is controlled in response to radio signals received by said antenna.

2. An autonomous radio timepiece according to claim 1, wherein said casing forms a recess for receiving said plug connector.

3. An autonomous radio timepiece according to claim 2 including a plug pin carried by said casing and projecting into said recess, said plug connector including a bush for removably receiving said plug pin.

4. An autonomous radio timepiece according to claim 3, wherein said plug connector includes a plastic sealing bar in which said bush is integrally molded, said sealing bar defining a funnel-shaped recess around said bush for sealingly engaging said plug pin.

5. An autonomous radio timepiece according to claim 4, wherein said plug connector includes a holding plate integrally molded in said sealing bar for retaining said bush in said sealing bar.

6. An autonomous radio timepiece according to claim 1, wherein said bracelet includes outer and inner strap tongues connected to said plug connector.

7. An autonomous radio timepiece according to claim 1, wherein said flexible support carries a printed antenna conductor and printed shielding conductors disposed on opposite sides of said antenna conductor.

8. An autonomous radio timepiece according to claim 7, wherein said core comprises a curved foil core tuned to a time message transmitter, said clock operating circuit including a receiver having an electrically tunable capacitor for a retunable resonance circuit as a function of the instantaneous curvature-dependent core inductivity during actuation of said receiver.

9. An autonomous radio timepiece comprising a wristwatch casing, an operating circuit and receiver disposed in said casing, a wrist bracelet having an internal channel, an antenna removably disposed in said channel, said antenna including a plug connector attachable to said casing and including means connecting said antenna with said circuit, said casing forming a recess for receiving said plug connector; a plug pin carried by said casing and projecting into said recess; said plug connector including a bush for removably receiving said plug pin; said plug connector including a plastic sealing bar in which said bush is integrally molded; said sealing bar defining a funnel-shaped recess around said bush for sealing engaging said plug pin.

10. An autonomous radio timepiece comprising a wristwatch casing, an operating circuit and receiver disposed in said casing, a wrist bracelet having an internal channel, an antenna removably disposed in said channel, said antenna including a plug connector attachable to said casing and including means connecting said antenna with said circuit, said casing forming a recess; a plug pin carried by said casing and projecting into said recess; said plug connector including a bush for removably receiving said plug pin; said plug connector including a plastic sealing bar in which said bush is integrally molded; said sealing bar being insertable into said recess; and a holding plate integrally molded in said sealing bar for retaining said bush in said sealing bar.

11. An autonomous radio timepiece according to claim 10, wherein said plug connector is secured to said casing by fasteners which extend through said holding plate.

12. An autonomous radio timepiece according to claim 10 wherein said plug connector includes a connecting strip for connecting said plug connector to said bracelet, an integrally molded portion of said plug connector comprised of said holding plate, bush and sealing bar including at least one peg connected to said connecting strip.

13. An autonomous radio timepiece according to claim 10, wherein said holding plate includes lugs for supporting a shaft around which a portion of said bracelet is looped.

14. An autonomous radio timepiece according to claim 10, wherein said holding plate includes a projection extending into an interior of said internal channel of said bracelet, said flexible support being fastened to said projection.

* * * * *